US010051948B2

(12) United States Patent
Carver et al.

(10) Patent No.: US 10,051,948 B2
(45) Date of Patent: Aug. 21, 2018

(54) UTILITY BELT

(71) Applicant: Atlas 46, LLC, Fenton, MO (US)

(72) Inventors: John W. Carver, Dittmer, MO (US); Keith Ericson, Barnhart, MO (US)

(73) Assignee: Atlas 46, LLC, Fenton, MO (US)

( * ) Notice: Subject to any disclaimer, the term of this patent is extended or adjusted under 35 U.S.C. 154(b) by 101 days.

(21) Appl. No.: 14/845,913

(22) Filed: Sep. 4, 2015

(65) Prior Publication Data

US 2017/0065067 A1 Mar. 9, 2017

(51) Int. Cl.
*A45F 5/00* (2006.01)
*A45F 5/02* (2006.01)

(52) U.S. Cl.
CPC ..... *A45F 5/021* (2013.01); *A45F 2200/0575* (2013.01)

(58) Field of Classification Search
CPC ..... A45F 5/021; A45F 2200/0575
USPC ..... 224/665
See application file for complete search history.

(56) References Cited

U.S. PATENT DOCUMENTS 2,643,803 A 6/1953 Bates
4,923,105 A * 5/1990 Snyder ..... A45F 3/14 224/232
5,259,093 A 11/1993 D'Annunzio
5,307,967 A 5/1994 Seals
5,363,863 A * 11/1994 Lelli ..... A61F 5/028 128/876
5,441,185 A * 8/1995 Dragos ..... A45F 5/02 15/236.01
5,499,965 A * 3/1996 Sanchez ..... A61F 5/028 128/100.1
5,503,620 A * 4/1996 Danzger ..... A61F 5/028 128/100.1
5,653,337 A * 8/1997 Cirigliano ..... A45C 3/00 206/373
5,724,707 A 3/1998 Kirk
D403,422 S * 12/1998 Affholter ..... D24/188
6,016,944 A 1/2000 Girbert
6,065,658 A 5/2000 Hashimoto
6,155,471 A 12/2000 Lichtenberger
6,179,185 B1 * 1/2001 Dancyger ..... A45F 5/02 206/373
6,213,365 B1 * 4/2001 Stocke ..... A41D 13/0012 224/223

(Continued)

*Primary Examiner* — Peter Helvey
(74) *Attorney, Agent, or Firm* — Husch Blackwell LLP

(57) ABSTRACT

A utility belt including a center member, a first wing member movable relative to the center member, a second wing member adjustable relative to the first wing member and movable relative to the center member, an adjustment member for adjusting the first and second wing members relative to each other, and an optional cummerbund which is releasably engageable with the center member. The utility belt includes a plurality of loop members for allowing different types of devices such as pouches, pockets, drill holsters, tools and other implements to be attached thereto at a desired location. The optional cummerbund increases the fit of the present belt to a particular user and also allows the present belt to better support attachments attached to one or more of the loop members. The optional cummerbund is also adjustable to further improve the fit and comfort of the present belt to the wearer.

18 Claims, 11 Drawing Sheets

(56) References Cited

U.S. PATENT DOCUMENTS 6,213,968 B1 * 4/2001 Heinz ..... A61F 5/028 602/19
6,315,179 B1 11/2001 Hillis
6,322,529 B1 * 11/2001 Chung ..... A61F 5/028 2/319
6,390,348 B1 * 5/2002 Godshaw ..... A45F 5/00 224/660
D480,535 S * 10/2003 Hammond ..... D2/627
6,769,137 B2 8/2004 D'Annunzio
6,892,914 B2 5/2005 Girbert
6,948,188 B2 9/2005 D'Annunzio
7,047,570 B2 5/2006 Johnson
7,083,585 B2 * 8/2006 Latham ..... A61F 5/028 602/19
7,163,132 B2 1/2007 Runberg
D545,565 S * 7/2007 Newman ..... D3/228
7,243,376 B2 7/2007 Johnson
7,318,542 B2 * 1/2008 Godshaw ..... A45C 7/0086 224/259
7,575,136 B2 * 8/2009 Kernkamp ..... A45F 3/14 224/158
8,844,717 B1 * 9/2014 Ross ..... B25H 3/00 182/129
D771,938 S * 11/2016 Kinskey ..... D3/228
D771,939 S * 11/2016 Kinskey ..... D3/228
2002/0068890 A1 * 6/2002 Schwenn ..... A61F 5/0193 602/19
2002/0108980 A1 8/2002 Kahn
2004/0238586 A1 * 12/2004 Godshaw ..... A45C 7/0086 224/625
2005/0059917 A1 * 3/2005 Garth ..... A61F 5/028 602/19
2005/0205633 A1 * 9/2005 Godshaw ..... A45C 7/0086 224/625
2005/0236454 A1 * 10/2005 Godshaw ..... F41C 33/0227 224/677
2006/0122547 A1 * 6/2006 Stewart, III ..... A61F 5/028 602/19
2008/0179368 A1 * 7/2008 Williams ..... A45F 3/14 224/682
2010/0168630 A1 * 7/2010 Cropper ..... A61F 5/024 602/19
2010/0204630 A1 * 8/2010 Sandifer ..... A61F 5/026 602/19
2010/0262056 A1 * 10/2010 Lusky ..... A61F 5/028 602/19
2013/0289461 A1 * 10/2013 Cropper ..... A61F 5/028 602/19
2014/0188023 A1 * 7/2014 Modglin ..... A61F 5/028 602/19
2014/0364786 A1 * 12/2014 Haider ..... A61F 5/028 602/19

* cited by examiner

UTILITY BELT

FIELD OF THE INVENTION

The present invention relates to a utility belt for carrying various tools and other devices/accessories to be accessed and utilized by wearers of the belt, for example, tradespersons. The utility belt, or tool belt, may be easily adjusted to fit a variety of waist sizes and to allow wearers to position various tools and other implements attached to the belt at preferred locations. The present belt includes adjustable wing members, an adjustable cummerbund, and a plurality of loops for compatibility with a modular attachment system disclosed in co-pending U.S. patent application Ser. No. 14/745,719 which provides for an attachment system that allows secure attachment of various removable items such as pouches, pockets, sheaths, drill holsters, and other tools and/or objects to be attached to the utility belt.

BACKGROUND OF INVENTION

Individuals ranging from "do-it-yourselfers" to professional tradespersons frequently employ utility or tool belts that include various pouches, pockets and the like for containing tools and other useful articles necessary for completion of certain tasks. The wearers of such tool belts have varying preferences on where they like their tools to be positioned on the tool belt. These preferences may depend on factors such as frequency of use of a particular tool or implement, weight of any given tool, or even something as simple as left or right handedness of a wearer.

Utility belts available in the marketplace often include pre-existing pockets, pouches, sheaths, or other devices made to hold tools and other accessories on the belt for use on a job. However, the aforementioned devices are positioned and located at a predetermined fixed position on a belt, and neither the tools nor the pre-existing pouches, pockets and other attachment devices are adjustable so as to be located at other positions preferred by a wearer of the belt. There is therefore a need to be able to position necessary pockets, pouches, or other similar devices where they may be most useful, comfortable, and/or convenient to an individual wearer.

Examples of hardware that may be employed for the task of securing tools and other objects on a utility belt in preferred, customizable locations include the use of hook and loop fasteners, carabineers, keepers with slides, buttons, snap fasteners, and other soft snap devices. Generally the problems associated with the aforementioned past methods and devices are the creation of unstable loads, bunching of items in one general location, unreliability of the attachment mechanism, and expense. Also, such past methods and devices are customizable only to a certain degree—the hardware may only be secured at predetermined locations on a belt, for example, sewn-in loops or snap receivers. In addition, the location of the attachment methods and devices associated with known utility belts cannot be repositioned around the waist of a wearer to maximize comfort and convenience to the wearer, or to more equally distribute the weight or load of tools attached to the belt. Such past systems are generally bulky and uncomfortable to the user.

Still further, since pockets and/or pouches sewn onto a utility belt cannot be repositioned, their fixed location may not be useful to a wearer. Some removable attachment systems have been developed, but involve intricate weaving of strapping to secure an object to a garment. See, for example, U.S. Pat. No. 5,724,707. While this is an improvement over permanent attachment systems, such a multiple layer strap weaving system is cumbersome and involves a significant amount of time to install.

Because many tools may be necessarily attached to a utility belt to be sure that a wearer is appropriately equipped for any given job, a utility belt can become heavy. A heavy utility belt supporting many tools and other implements may be particularly susceptible to falling off of the waist of the wearer. Utility and other tool belts known in the art often include an adjustable strap member that circles the waist of a wearer. This strap typically includes male and female buckle members which are able to be coupled and decoupled with one another to secure and release a belt from a wearer. Disadvantageously, utilizing only such an adjustable strap and buckle device can result in the strap loosening while the utility belt is worn due to the weight borne on the utility belt by tools and other useful implements that are in pockets or pouches attached to the belt, or hanging from the belt. If a belt becomes too heavy, it could sag on the waist of a wearer, or even fall off the waist of a wearer.

It is therefore clearly evident that a need exists for a lightweight, low bulk (flat against the user), secure yet comfortable, and customizable utility belt that can be used with a variety of different tools and accessories as well as utilizing a customizable attachment mechanism. It is therefore an object of the invention to provide a lightweight, yet durable and adjustable, secure fitting, and comfortable utility belt that allows for precise, customizable positioning of useful implements for the wearer. It is further an object of the invention to provide a utility belt that supports the weight of a modular attachment system which is readily usable to attach a plurality of useful objects thereto, regardless of the weight of implements attached thereto.

SUMMARY OF INVENTION

The present invention relates to an adjustable, customizable utility belt for selectively attaching various tools, implements and other accessories and objects thereto in positions and locations around the belt preferred by a wearer. For example, pouches, pockets, and other devices for storing and/or transporting useful tools and instruments may be attached to the utility belt. The utility belt also provides added support to assist in preventing the weight of attachments to the utility belt from causing the belt to sag or fall from the wearer's waist.

The present utility belt generally includes a center belt member and right and left wing members that each extend outwardly from each other and the center member. An adjustment member in the form of a cord, lace, or other similar device adjustably attaches the wing members to each other and the center member and allows a user to adjust the relative position of the right and left wing members to each other to accommodate for varying waist sizes. This allows a user to fit the belt to the user's waist and it also allows a user to position and locate the right and left wing members at a preferred location that will allow the user to position various tools and other useful implements at comfortable and/or convenient locations on the utility belt. Adjusting the right and left wing members of the utility belt may also help improve the fit and comfort of the utility belt.

Each opposite end of the left and right wing members includes a corresponding fastening member, such as an adjustable strap member, for releasably attaching the opposite ends of the wing members around the waist or midsection of a wearer. One end of each strap member is fixedly attached to one end of the left and right wing members and the opposite end of each strap member may be attached to each other using male and female buckle or clip members in a manner that is widely used and well understood in the art. One or both strap members attached to the respective left and right wing members may be adjustable and adjustment of the strap member(s) securely attaches the utility belt to the waist of the user.

Optionally, the utility belt may also include an adjustable cummerbund to improve the comfort and the support of the utility belt. In one embodiment, the cummerbund includes two cummerbund members which may be selectively releasably attachable at one end to the center member of the belt at various locations to expand or contract the overall size of the cummerbund. At the end portions of each respective cummerbund member not attached to the center member, Velcro hook and/or loop fasteners may be provided to allow those end portions of the cummerbund members to be attached at the rear of a wearer. When the cummerbund has been sized and fitted to a wearer's waist, it will provide additional support to the belt to help prevent attachments that are releasably engaged with the belt from pulling the belt downwards or even causing the belt to fall off. The cummerbund may also provide additional fit and comfort to a wearer. An upper flap member and a lower flap member associated with the center member of the belt may be used to conceal and further secure the cummerbund to the utility belt.

The exterior of the present utility belt preferably includes a plurality of loop members that extend circumferentially around the belt. In one embodiment, the loop members are stitched to the exterior of the belt and one portion of an attachment mechanism is provided that is releasably engageable with the loop members. The opposite end portion of the attachment mechanism is provided on the item to be attached to the utility belt such as on a pouch, pocket or other item. For example, the attachment mechanism may include a male and female buckle/clip member as commonly known in the art that are mateable with each other, the female portion of the buckle or clip member being attachable to one of the loop members and the male portion of the buckle or clip member being associated with the pouches, pockets, sheaths, or drill holsters that are fabricated specifically for attachment to the present belt, that is, for selective engagement with the female portion of the buckle or clip member selectively attached to a loop member.

In still another embodiment of the present utility belt, the integrated modular attachment system disclosed in co-pending U.S. patent application Ser. No. 14/745,719 the disclosure of which is incorporated herein by reference in its entirety, can likewise be associated with any one of the selectively attachable pockets, pouches, sheaths, holsters and other devices which can be attached to the present utility belt. This integrated modular attachment system includes a foldable flap associated with the particular item or object to be attached to the present belt, a first wing member extending from one side of the object or item to be attached to the present utility belt, and a second wing member extending from its opposite side. To secure the item or object, such as a pocket, pouch or other device, to the present utility belt, the foldable flap is positioned in a downward position and inserted through at least one of the loop members associated with the exterior of the present utility belt. The first wing member is then folded into a position which overlaps a portion of the foldable flap and is removably secured to the foldable flap. The second wing member is then folded over to overlap the first wing member and is removably secured to at least the first wing member. This arrangement releasably attaches a particular item or object to the present utility belt in a secured manner and allows a user to easily remove the item or object from the belt by simply reversing the above steps. Since a plurality of loop members are associated with the exterior of the present utility belt, any particular pouch, pocket, holster, or other device can be easily and securely attached to the present utility belt at any loop member location and the same item or object can be disengaged and selectively repositioned to any other loop member associated with the present utility belt as needed by the particular user.

Other aspects and advantages of the present invention will be apparent to a person skilled in the art from the following detailed description of the various embodiments and the accompanying drawings.

DESCRIPTION OF THE DRAWINGS

In the accompanying drawings, which form a part of the specification and are to be read in conjunction therewith in which like reference numerals are used to indicate like or similar parts in the various views.

DETAILED DESCRIPTION OF THE INVENTION

Figure 1:
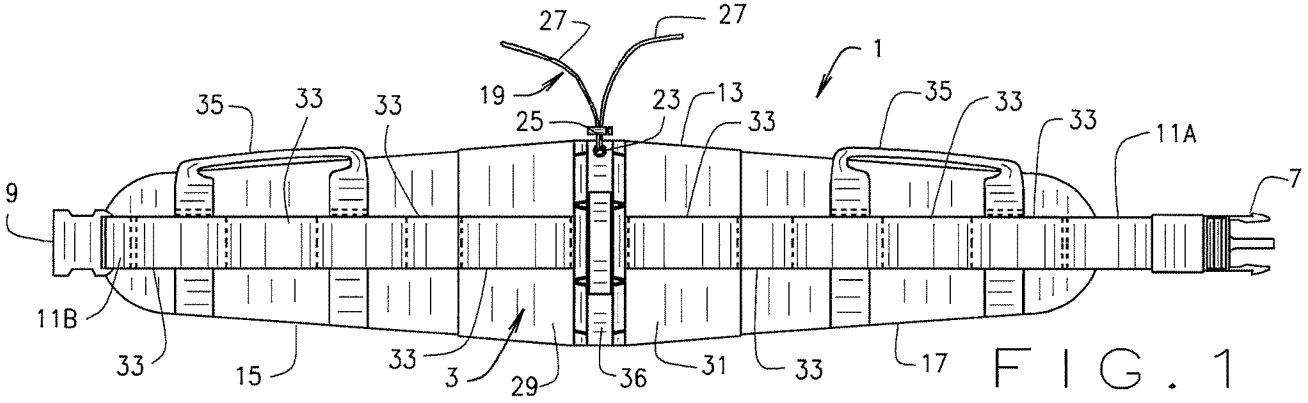
FIG. 1 is a front elevational view of a utility belt constructed according to the teachings of the present invention.

The present invention will now be described with reference to the drawing figures in which like reference numerals refer to like parts throughout the application. For purposes of clarity in illustrating the various characteristics of the present invention, proportional relationships of the various elements have not necessarily been maintained in the drawing figures.

Figure 2:
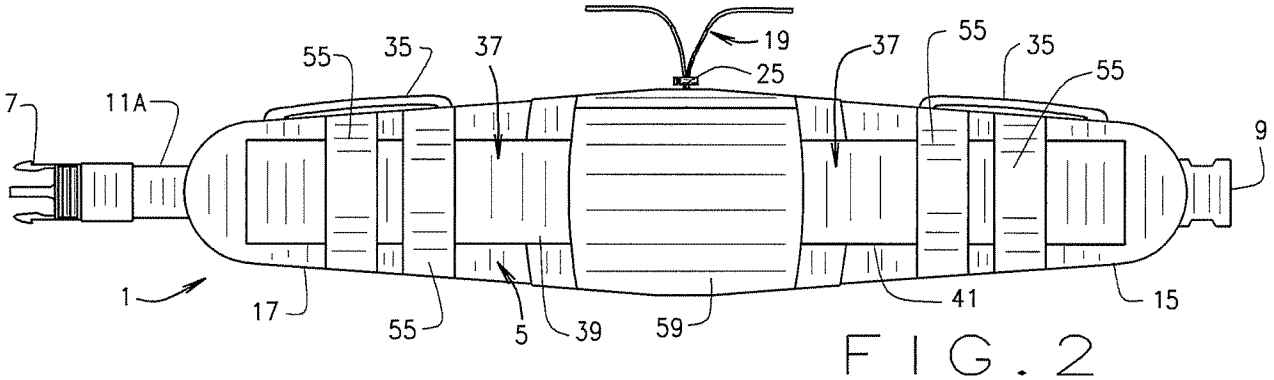
FIG. 2 is a rear elevational view of the utility belt of FIG. 1.
Figure 3:
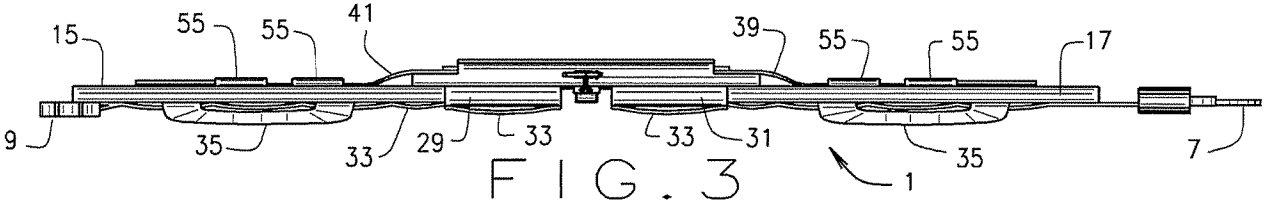
FIG. 3 is a top plan view of the utility belt shown in FIGS. 1 and 2.
Figure 4:
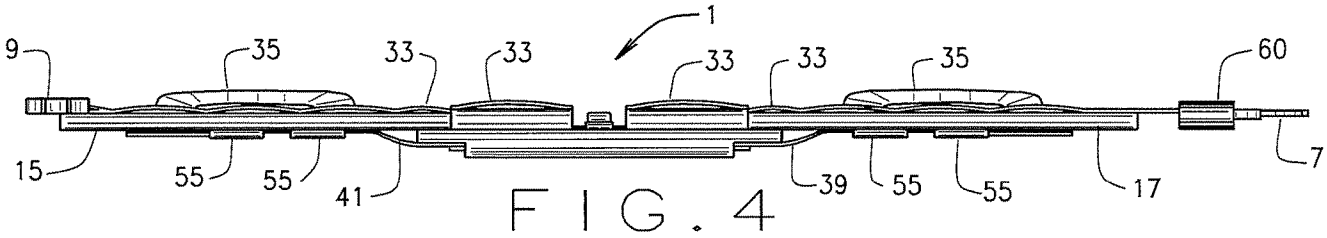
FIG. 4 is a bottom plan view of the utility belt shown in FIGS. 1-3.

Referring to the drawings more particularly by reference numbers wherein like numerals refer to like parts, FIGS. 1-6 illustrate one embodiment of the present utility belt 1 for selectively attaching various tools, implements and other attachments thereto such as, for example, pouches and/or pockets for holding tools and accessories such as nails, screws and other fastening devices, holsters for carrying a drill, and many other various tools and/or instruments that may be useful for a wearer of the present utility belt 1 in order to complete a specific job or task. FIG. 1 illustrates a front elevational view of the present utility belt 1 showing an exterior side 3 which is exposed when the belt is worn by a user, and FIG. 2 illustrates a rear elevational view of the present utility belt 1 showing an interior side 5 which will lie adjacent a user's body when the present belt is operatively worn. When properly worn, exterior side 3 faces outwardly from a wearer, while interior side 5 abuts and lies adjacent to the mid-section or waist of a wearer.

The present utility belt 1 may be releasably secured around the waist or mid-section of a user by simply mating together a male fastener member 7 and a female fastener member 9 which simply couple and decouple together in a manner well-known in the art as illustrated in FIGS. 1 and 2. Male fastener member 7 and female fastener member 9 are attached at one end portion respectively thereof to corresponding strap members 11A and 11B, which strap members are likewise fixedly attached to one end portion of left wing member 15 and right wing member 17 as will be hereinafter further explained. Either one or both of strap members 11A and 11B can be made adjustable in a manner well-known in the art such that utility belt 1 may fit snugly and securely around a wearer's waist.

Figure 5:
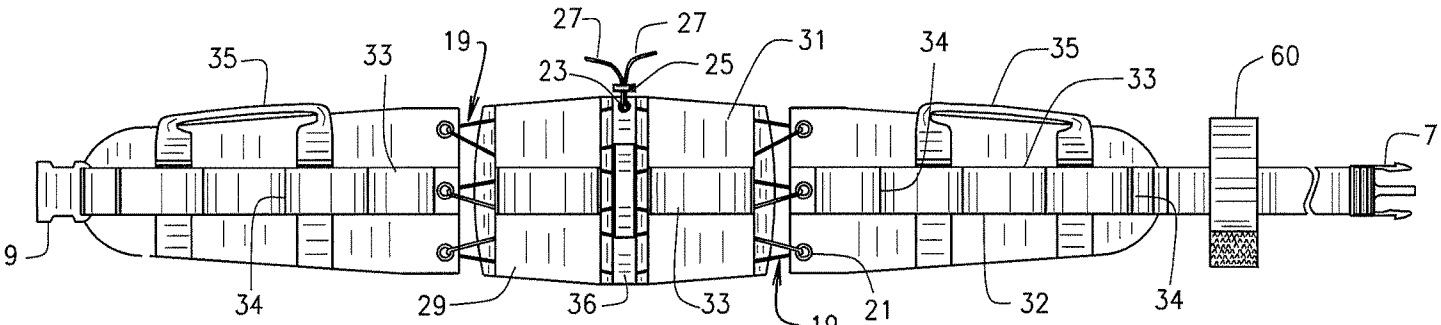
FIG. 5 is a front elevational view of the utility belt shown in FIG. 1 with left and right wing members extended from the center portion member thereof.

As best illustrated in FIGS. 1-6, the present utility belt 1 includes a center belt member 13, a left wing member 15, and a right wing member 17. An adjustment member 19 adjustably attaches the respective wing members 15 and 17 to each other and allows a user to adjust the relative position of the right and left wing members to each other and to move the wing members relative to the center member to accommodate for varying waist sizes. Adjustment member 19 typically takes the form of a cord, lace or other similar device which is threaded through corresponding holes or openings 21 associated with one end portion of each of the respective left and right wing members 15 and 17 as best illustrated in FIG. 5. Adjustment member 19 allows the respective wing members 15 and 17 to be moved relative to each other and relative to the center member 13 so as to extend and/or contract the wing members to adjust the utility belt 1 to a length that is snug yet comfortable for a particular waist size of a particular wearer. The adjustment member or cord member 19 is laced through the apertures 21 as illustrated most clearly in FIG. 5. The cord member 19 is laced similar to lacing a shoe and the opposite end portions 27 of cord member 19 are positioned through aperture 23 such that the opposite end portions 27 are pulled upwardly through aperture 23. Aperture 23 is associated with the center pouch or pocket 36 of center member 13 as will be further explained.

A stop member 25 is slidably positioned along the opposite end portions 27 of cord member 19 as again best shown in FIGS. 1 and 5. When the loose ends 27 of cord member 19 are pulled upwardly through aperture 23, cord member 19 will pull the respective wing members 15 and 17 inwardly towards each other relative to the center member 19 thereby contracting the relative position between the respective wing members. In reverse fashion, if the respective wing members 15 and 17 are pulled away from each other, the adjustment cord 19 will allow the wing members to extend outwardly away from each other and the loose end portions 27 of cord member 19 will be pulled inwardly through aperture 23. This will allow a user to extend the overall size of the utility belt 1 to fit the user's particular waist size thereby increasing the overall size of the utility belt. When wing members 15 and 17 have been adjusted to a desired position for a particular user, stop member 25 may be depressed and positioned to secure the attachment cord 19 at the desired position of wing members 15 and 17. Stop member 25 may be a plastic spring-loaded cord lock typically known in the art which can be slidably moved along the loose ends 27 of cord member 19 so as to position the stop member 25 adjacent aperture 23 to hold the adjustment cord member 19 at its desired position. This will lock the wing members 15 and 17 in the desired position and will not allow the wing members to be further extended.

This adjustment mechanism allows a user to fit the present belt 1 to the user's waist and it also allows a user to position and locate the left and right wing members 15 and 17 at a preferred location as will be hereinafter further explained. Although a conventional spring-loaded cord lock 25 is illustrated for accomplishing this task, it is recognized and anticipated and that other stop members capable of suitably securing cord member 19 at a particular location can likewise be utilized and are also envisioned for use in the present invention. This ability to move the left and right wing members 15 and 17 relative to the center member 13 and to adjust the wing members 15 and 17 relative to each other helps to improve the fit and comfort of a utility belt on a particular wearer.

Each opposite end of the left and right wing members 15 and 17 includes the corresponding strap members 11A and 11B, each of which likewise includes a corresponding fastening member 7 and 9 for releasably attaching the opposite ends of wing members 15 and 17 around the waist or mid-section of a wearer. As previously explained, one end of each strap member 11A and 11B is fixedly attached to one end portion of the left and right wing members 15 and 17 as best illustrated in FIGS. 1-6. The opposite end portion of each respective strap member 11A and 11B includes male or female buckle or clip member 7 or 9 which are cooperatively engageable with each other in a conventional manner. One or both of the strap members 11A and 11B attach to the respective left and right wing members 15 and 17 may also be adjustable and adjustment of the strap members 11A and/or 11B further securely attaches the utility belt 1 to the waist of the user.

As best illustrated in FIG. 5, center member 13 preferably includes a right sleeve member 29 and a left sleeve member 31 for respectively receiving left and right wing members 15 and 17. Sleeve members 29 and 31 extend horizontally a predetermined distance over the exterior side 3 of center member 13 and each sleeve member forms an opening between the exterior side 3 of center member 13 and the interior side portion of the respective sleeve members 29 and 31 for receiving at least a portion of the respective end portions of wing members 15 and 17 as best illustrated in FIG. 5. Sleeve members 29 and 31 function to hold the respective wing members 15 and 17 in proper position and alignment relative to center member 13 and they likewise provide protection for the adjustment cord member 19 which is laced therebehind.

The exterior side portion 3 of utility belt 1 likewise includes a plurality of loop members 33 positioned and located along the length of utility belt 1 including across the sleeve members 29 and 31 as well as the respective wing members 15 and 17 for selectively engaging various tools, implements, pouches, pockets and other useful articles in a manner described hereinafter in greater detail with respect to FIGS. 15-20. The plurality of loop members 33 can be formed by stitching or otherwise fastening one or more strips of webbing or other material 32 attached to the respective belt members 13, 15 and 17 at various locations along their length such as at locations 34. The webbing or other material 32 may be attached to the utility belt using any other coupling methods such as, for example, fusing the webbing or material 32 to utility belt 1 at distinct point 34, or using an adhesive or a mechanical fastener such as a rivet or like fastener. The loop members 33 provide an attachment mechanism as will be hereinafter described for attaching various tools, implements and other devices to the utility belt. By adjusting wing members 15 and 17 relative to each other and the center member 13 as previously described, loop members 33 may likewise be positioned and located in a preferred position for a particular user for attaching various tools and implements thereto. Although the webbing 32 is disposed in a horizontal position relative to belt members 13, 15 and 17, a vertical or angular orientation of the webbing 32 is also contemplated and within the scope of the present invention depending upon the overall size of utility belt 1.

Exterior side portion 3 of utility belt 1 may also include a pair of handle members 35 which may be stitched or otherwise attached to each respective wing member 15 and 17 at the top of utility belt 1 as best illustrated in FIGS. 1, 2 and 5. Handle members 35 are positioned and located so as to be utilized by a wearer to assist in donning utility belt 1, or adjusting the belt while worn. Center belt member 13 may also include a center pouch or pocket 36 positioned and located on the exterior side 3 thereof for holding and storing smaller devices or implements such as a pencil or other marking instrument, small files, and other long, slender tools. The center pouch or pocket 36 may be integrally formed with center member 13 or it may be attached thereto using any suitable fastening means such as stitching the center pouch 36 to center member 13. The aperture 23 is associated with the center pouch or pocket 36 and when the cord member 19 is pulled through aperture 23, the left and right wing members 15 and 17 are engaged with the center member 13.

Figure 6:
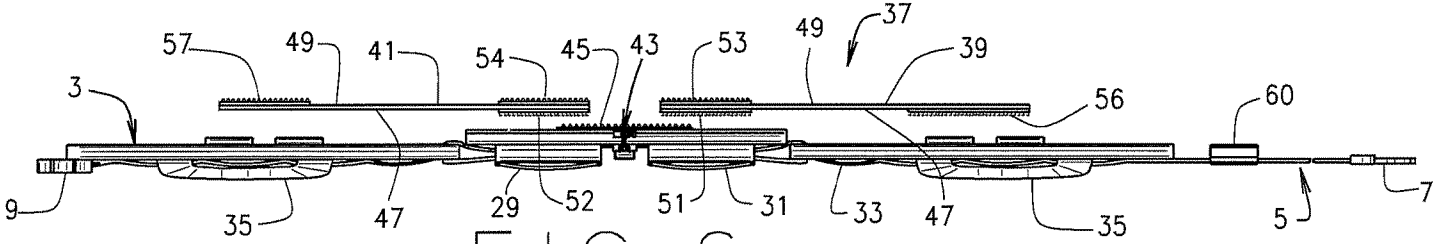
FIG. 6 is a top plan view of the utility belt shown in FIG. 5, with the present cummerbund members positioned in an exploded view for attachment to the utility belt.

Because the loop members 33 may be used to attach a wide variety of different tools, implements, pouches, pockets and other articles and objects to the utility belt 1, the present belt may become heavy around the waist of a user. As such, in addition to the adjustable wing members 15 and 17 as well as the adjustable strap members 11A and/or 11B for attaching the present belt to a weaver, the present utility belt 1 may also include an adjustable cummerbund 37 as best illustrated in FIGS. 2 and 6-14 to further improve the comfort and support of the present utility belt. Cummerbund 37 is positioned and located on the interior side portion 5 of the belt 1 and, in one embodiment, includes two cummerbund members 39 and 41 which may be selectively releasably attachable at one end portion respectively thereof to center belt member 13 at various locations therealong to expand or contract the overall size of the cummerbund 37. FIG. 6 illustrates cummerbund members 39 and 41 exploded from the interior side portion 5 of utility belt 1; FIGS. 7-10 illustrate the present cummerbund members 39 and 41 in various exploded and attached positions as will be hereinafter further explained; and FIGS. 11-14 illustrate cummerbund members 39 and 41 in isolation and unattached to any portions of the present utility belt 1.

Figure 7:
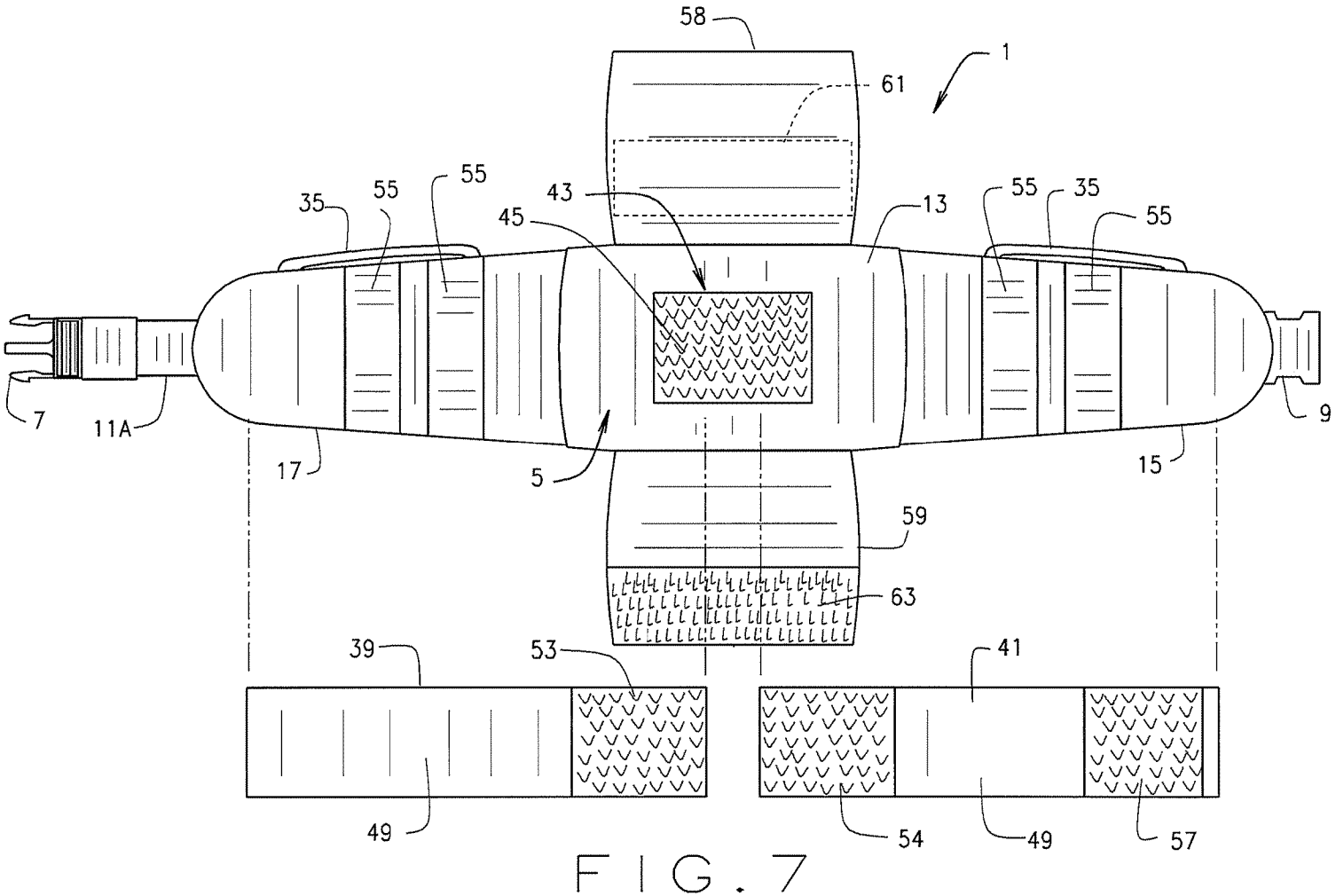
FIG. 7 is an exploded view of the utility belt shown in FIG. 2 with the upper and lower flap members of the center member positioned in their unfolded or open position for receiving the cummerbund members.

As best illustrated in FIGS. 6 and 7, interior side portion 5 of the center belt member 13 includes an attachment mechanism 43 for releasably attaching one end portion of each of cummerbund members 39 and 41 thereto. In one embodiment, attachment mechanism 43 is a Velcro® patch made up of loop engaging fasteners 45 as commonly known in association with Velcro® products. As best shown in FIG. 6 and in greater detail in FIGS. 11-14, each of the cummerbund members 39 and 41 includes a front side portion 47 and a rear side portion 49. The front side portion 47 of cummerbund member 39 includes a corresponding mating attachment mechanism 51 such as the hook engaging portion of a Velcro® fastener for releasable engagement with the loop engaging portion 45 of the center belt member 13. In similar fashion, cummerbund member 41 includes a mating attachment mechanism 52 such as the hook engaging portion of a Velcro® fastener that may likewise be releasably enagageable with the loop engaging portion 45 of the center member 13. The opposite side portions of attachment mechanisms 51 and 52 likewise include mating attachment mechanisms 53 and 54 such as hook and loop Velcro® fasteners for releasably engaging attachment mechanisms 51 and 52. More particularly, Velcro® fastener member 51 is releasably engageable with Velcro® fastener member 54 and Velcro® fastener member 52 is likewise releasably engageable with Velcro® fastener member 53 as will be hereinafter explained.

Figure 8:
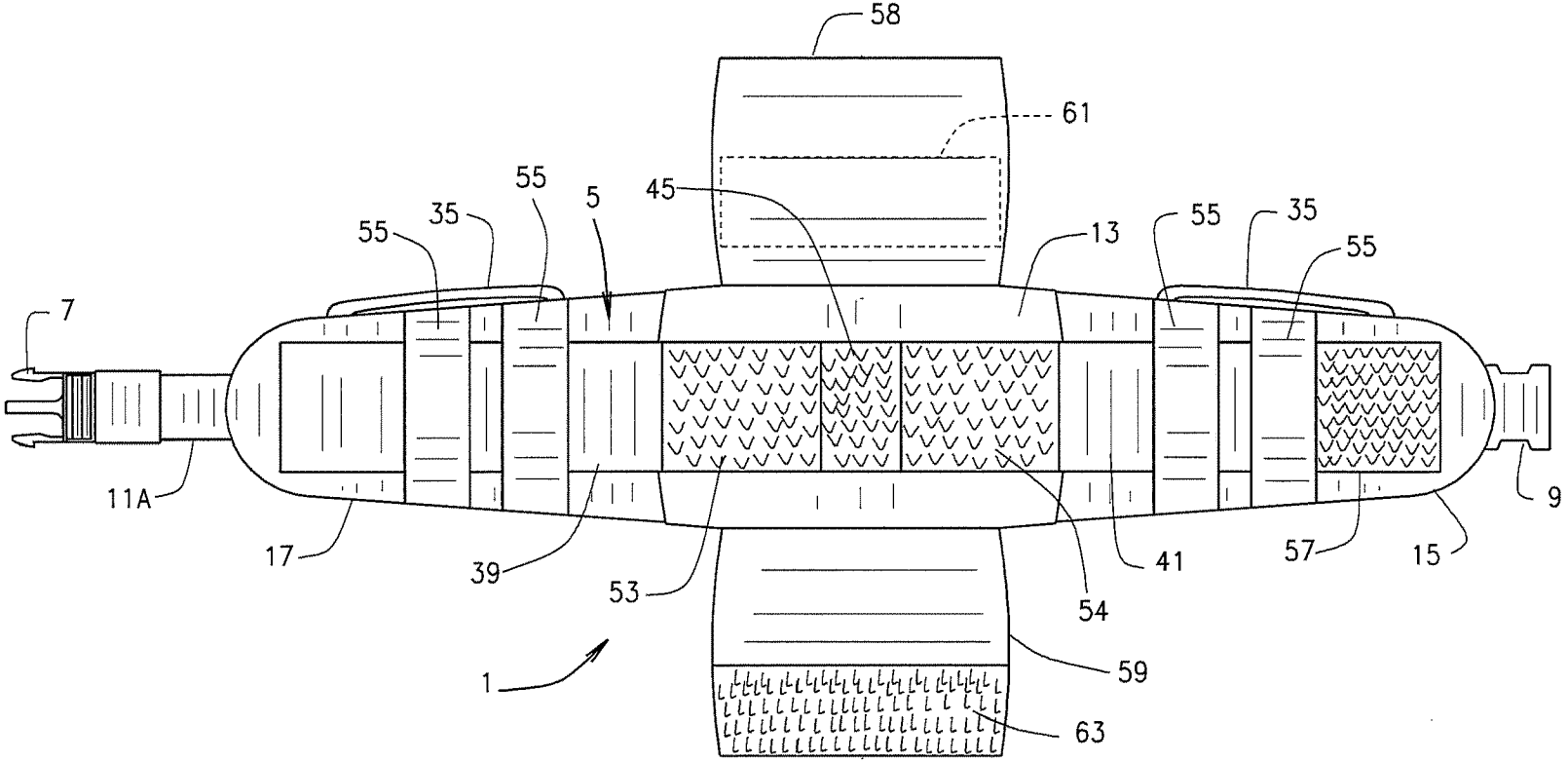
FIG. 8 is a near elevational view of the utility belt shown in FIG. 7 with the cummerbund members attached to the center member in spaced apart relationship to each other, and secured within receiving straps associated with the utility belt.
Figure 9:
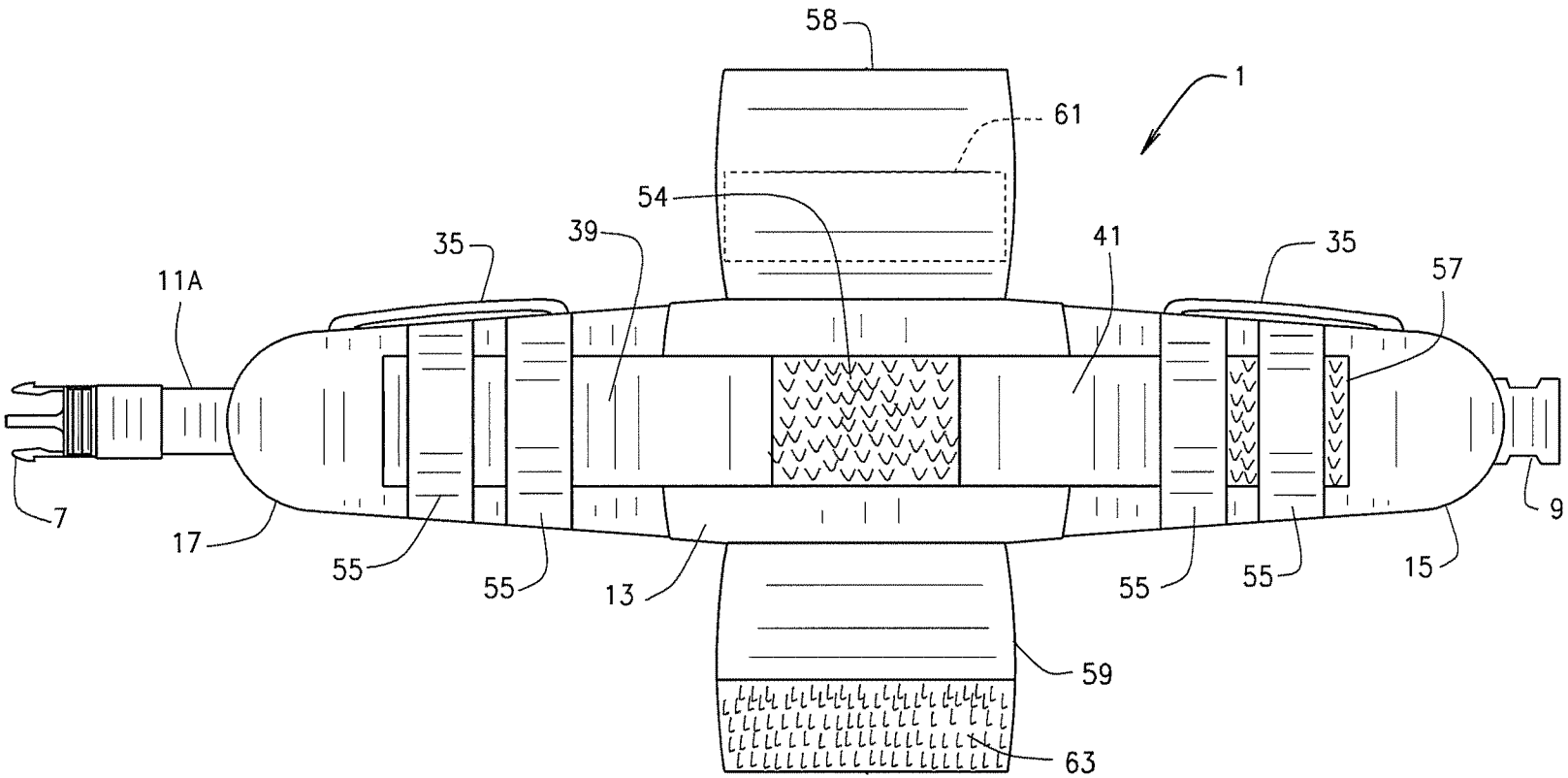
FIG. 9 is a rear elevational view of the utility belt shown in FIG. 8 with the right and left cummerbund members overlapping one another.

As best illustrated in FIGS. 7 and 8, the respective cummerbund members 39 and 41 can be selectively releasably attached to the center belt member Velcro® patch 45 in a wide variety of different spaced apart configurations so as to extend or contract the overall size of the cummerbund 37 based upon the waist size of the user. If the cummerbund 37 needs to be further contracted or reduced in overall length, the opposite end portions of cummerbund members 31 and 41 may be overlapped and attached to each other as best illustrated in FIG. 9 before this combination is attached to Velcro® patch 45. In this situation, mating Velcro® surface 52 may be overlapped with mating Velcro® surface 53 or mating Velcro® surface 51 may be overlapped with mating Velcro® surface 54 and the resultant combination may thereafter be attached to mating Velcro® surface 45. This will allow a user to further contract or reduce the overall length of cummerbund 37 so as to size the cummerbund 37 to the particular waist size of the user. It should also be noted that as clearly shown in FIGS. 2 and 7-10, each respective wing member 15 and 17 includes at least one strap member 55 associated with the interior side portion 5 of each respective wing member. In one embodiment, the strap members 55 are sewn onto the interior side portion of each respective wing member 15 and 17. Strap members 55 are positioned and located to receive the respective cummerbund members 39 and 41 when such members are attached to the center belt member 13 as best illustrated in FIGS. 2 and 8-10.

As again illustrated in FIG. 6, the opposite end portions of each respective cummerbund member 39 and 41 which is not attached to the center member 13 likewise includes a corresponding attachment mechanism 56 and 57 such as corresponding Velcro® hook and/or loop fasteners which are provided to allow those respective end portions of the cummerbund members 39 and 41 to be attached to each other at the rear of a wearer. In this regard, the front side portion 47 of cummerbund member 39 includes a mating Velcro® hook or loop fastener 56 which is positioned and located at its opposite end portion so as to releasably engage a corresponding Velcro® hook or loop fastener 57 positioned and located at its opposite end portion on the rear side portion 49 of cummerbund member 41. This positioning and location of the respective Velcro® fasteners 56 and 57 allow the cummerbund members 39 and 41 to be attached to each other around the waist of a particular user so as to provide additional support and security to the belt when worn as will be further explained. Using the cummerbund 37 in combination with the adjustable wing members 15 and 17 will provide additional support to the overall belt to help prevent attachments that are releasably engaged with the belt as will be hereinafter further explained from pulling the belt downwards or even causing the belt to fall off. The cummerbund 37 may also provide additional fit and comfort to the wearer since it will be secured first to the waist or mid-section of a particular user and the cooperatively engageable straps 11A and 11B will thereafter be secured over the cummerbund to provide an extra level of both support and strength to the overall utility belt 1.

When a wearer is sizing cummerbund 37 to fit his or her waist, a wearer may start by releasably attaching Velcro® fastening members 51 and 52 at a preferred lateral position on Velcro® attachment mechanism 45 that snugly yet comfortably allows cummerbund 37 to fit around the wearer's waist. FIG. 7 illustrates an exploded view of cummerbund members 39, 41 in a position wherein attachment mechanisms 51 and 52 (FIG. 6) may be pushed downwardly until engaged with attachment mechanism 45 using the aforementioned loop and hook fasteners associated therewith. The cummerbund members 39 and 41 can be moved and repositioned on Velcro fastening member 45 relative to each other in order to achieve the proper fit. As shown in FIG. 8, once cummerbund 37 is in its desired position, portions of cummerbund members 39 and 41 extending outwardly and away from center belt member 13 may be received and engaged by at least one strap member 55 associated with the interior side portion 5 of each wing member 15 and 17. In the preferred embodiment, a plurality of strap members 55 are utilized and fixedly attached onto interior side portion 5 of wing members 15 and 17 such as by being sewn or otherwise attached thereto.

FIG. 9 illustrates an alternative means for sizing cummerbund 37 for wearers with smaller waist sizes. As shown in FIG. 9, cummerbund member 39 may be placed such that its attachment member 51 (FIG. 6) is selectively engaged with attachment member 45 of center member 13 in the manner described above. However, in order to shorten the length of cummerbund 37, rather than being positioned away from cummerbund member 39 on attachment member 45, cummerbund member 41 is overlapped with cummerbund member 39 such that fastening member 52 of cummerbund member 41 is attached to fastening member 53 of cummerbund member 39. As such, when cummerbund members 39 and 41 are overlapped as shown in FIG. 9, loop fasteners 54 of cummerbund member 41 will be exposed at center member 13 as illustrated in FIG. 9. This attachment method allows a user to even further shorten the overall length of cummerbund 37 to achieve the desired fit.

Figure 10:
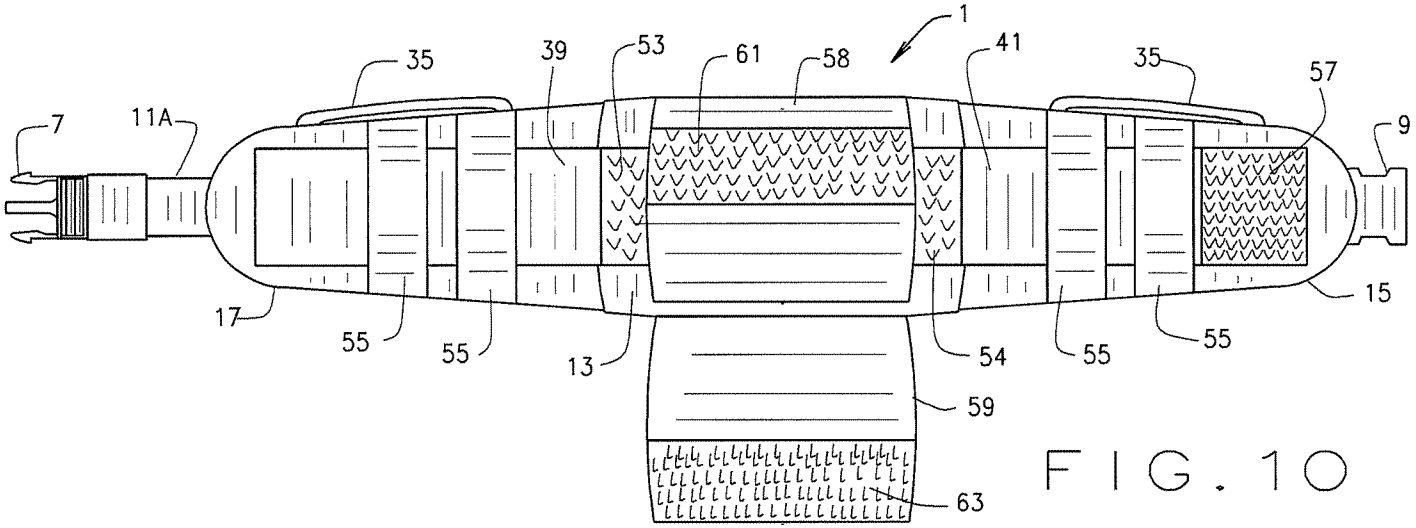
FIG. 10 is a rear elevational view of the utility belt shown in FIG. 8 with the lower foldable flap member positioned in its closed or folded down position over the cummerbund members.
Figure 11:
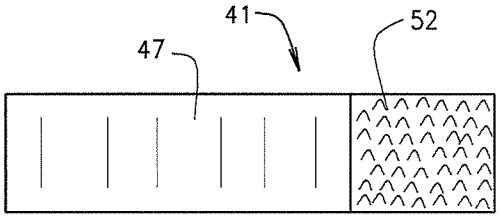
FIG. 11 is a front elevational view of the right cummerbund member as illustrated in FIG. 10.
Figure 12:
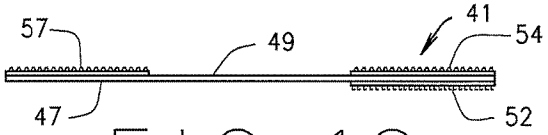
FIG. 12 is a top plan view of the right cummerbund member as illustrated in FIG. 11.
Figure 13:
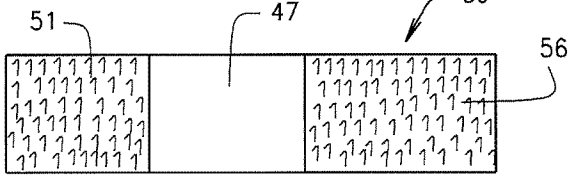
FIG. 13 is a front devotional view of the left cummerbund member as illustrated in FIG. 10.
Figure 14:
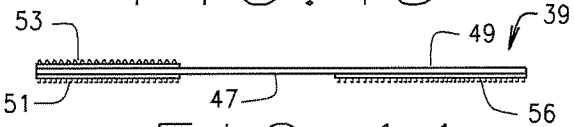
FIG. 14 is a top plan view of the left cummerbund member as illustrated in FIG. 13.

After cummerbund 37 has been fixed to a desired length for a given waist sue of a wearer and appropriately attached to center member 3 as described above, cummerbund 37 may be further reinforced to prevent utility belt 1 from sagging or falling off of a wearer's waist through the use of overlapping flap members 58 and 59 as will be further explained. As best shown in FIGS. 7-10, center member 13 of utility belt 1 preferably includes both a foldable upper flap member 58 and a foldable lower flap member 59. Upper flap member 58 preferably includes Velcro® hook fasteners 61 (FIG. 10) located on the back side of flap member 58 as illustrated in FIGS. 7-9 which are positioned and located for selective engagement with Velcro® loop fasteners 63 that are positioned and located on the front side 3 of lower flap member 59 as also illustrated in FIGS. 7-9. Cummerbund 37 may be even further secured to utility belt 1 by first folding upper flap member 58 downwardly over the engagement of cummerbund members 39 and 41 as illustrated in FIG. 10 and then therefore folding lower flap member 59 upwardly over flap member 58 such that hook and loop fasteners 61 and 63 selectively engage one another. Shielding the attachment of cummerbund members 39 and 41 to center member 13 through the use of overlapping flap members 58 and 59 provides added security to the connection and helps to prevent disengagement and/or movement of the cummerbund members 39 and 41 relative to each other once the desired fit is achieved, and it also provides a smooth surface for abutting the midsection of the user since the back side of lower flap member 59 is smooth as illustrated in FIG. 2.

When donning utility belt 1 after cummerbund 37 has been sized and fitted to a particular user, a user will first position cummerbund 37 around his or her waist and thereafter first attack the opposite end portions of cummerbund members 39 and 41 by engaging fastening members 56 and 57. Once cummerbund 37 is attached, a user may next adjust strap members 11A and 11B in a manner commonly known in the art and then attach wing members 15 and 17 to each other by mating male and female buckle/clip members 7 and 9. This secures utility belt 1 to the waist of a user. Use of both the adjustable cummerbund 37 and the adjustable wing members 15 and 17 provides for a strong, stable, secure, and non-sagging attachment of the present utility belt 1 to the body of a user. Stop member 60, as best illustrated in FIG. 5, serves as an excess webbing keeper to secure the length of webbing or straps 11A and/or 11B that are left over after a user tightens the adjustable strap members 11A and 11B to the user's particular waist thereby keeping these strap portions from swinging freely or getting snagged on anything during use of the belt 1.

Although the attachment/fastening means described above in association with center member 13, cummerbund members 39 and 41, and overlapping flap members 58 and 59 have been described as mating Velcro® surfaces such as mating hook and loop fasteners, it is also recognized and anticipated that a wide variety of other attachment/fastening mechanisms known and used in the art may likewise be used to accomplish the above-described engagements such as wide variety of other mating mechanical fastening systems like cooperating snap, clip or other releasable mechanical fasteners which are configured to mate with and releasably secure the various mating surfaces. A plurality of such other mating mechanical fastening systems can likewise be utilized to provide adjustability in the horizontal direction. Still further, it is also recognized and anticipated that the Velcro® mating surfaces disclosed above may be one mating surface can be a Velcro® hook fastener associated with that particular surface and a Velcro® hook fastener associated with a particular mating surface could likewise be a Velcro® loop fastener. Other arrangements and combinations of the various attachment mechanisms and various mating surfaces associated with the present utility belt 1 are likewise recognized, anticipated and envisioned.

Figure 15:
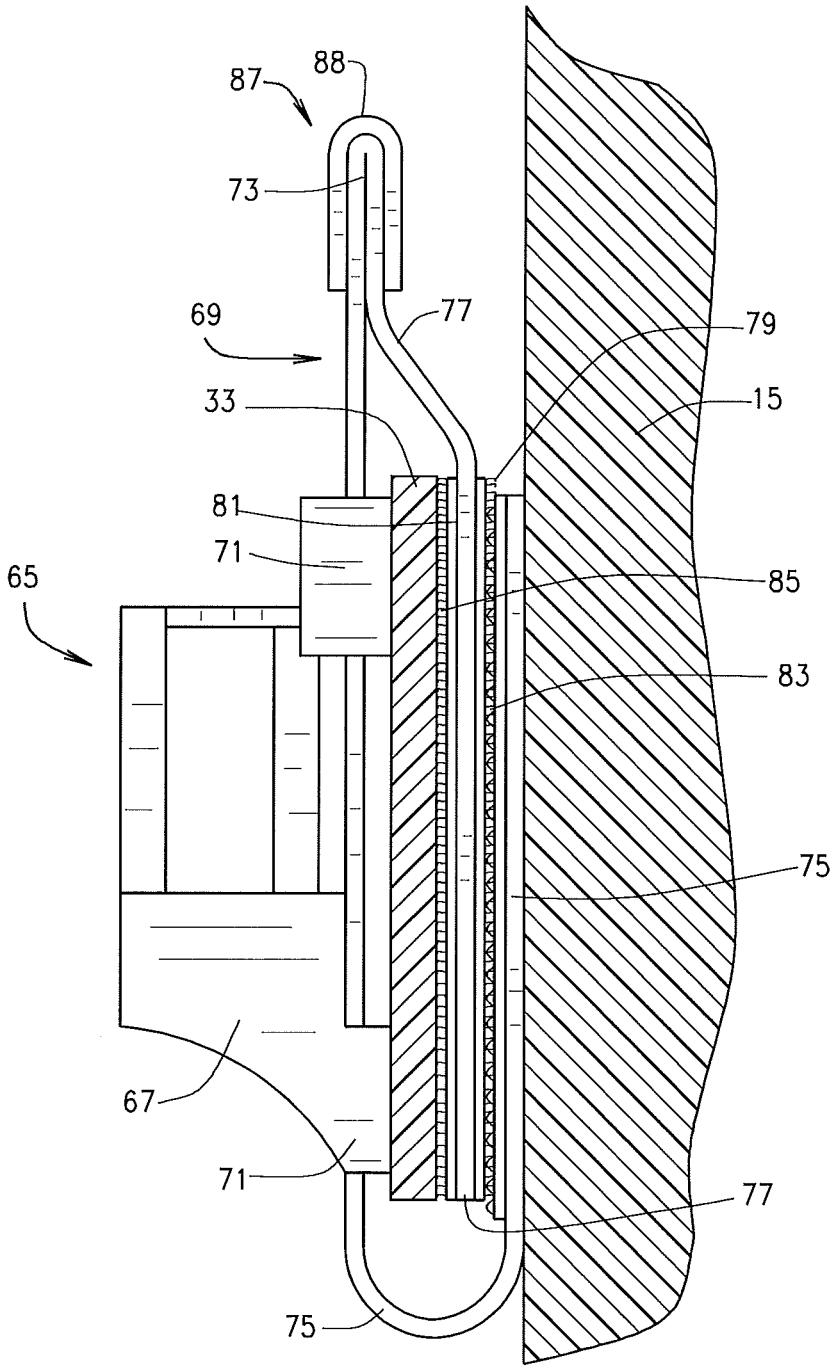
FIG. 15 is a cross-sectional view of an attachment member engaged with a loop member of the present utility belt.
Figure 16:
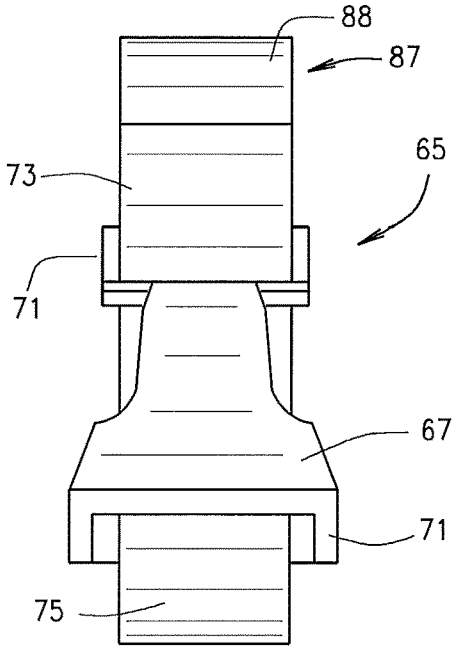
FIG. 16 is a front elevational view of the attachment member shown in FIG. 15.
Figure 17:
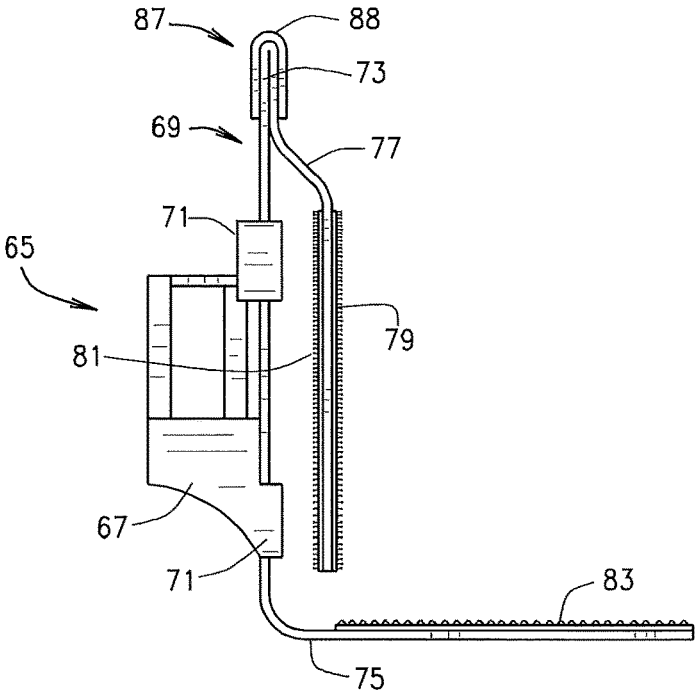
FIG. 17 is a side elevational view of the attachment member shown in FIGS. 15 and 16.
Figure 18:
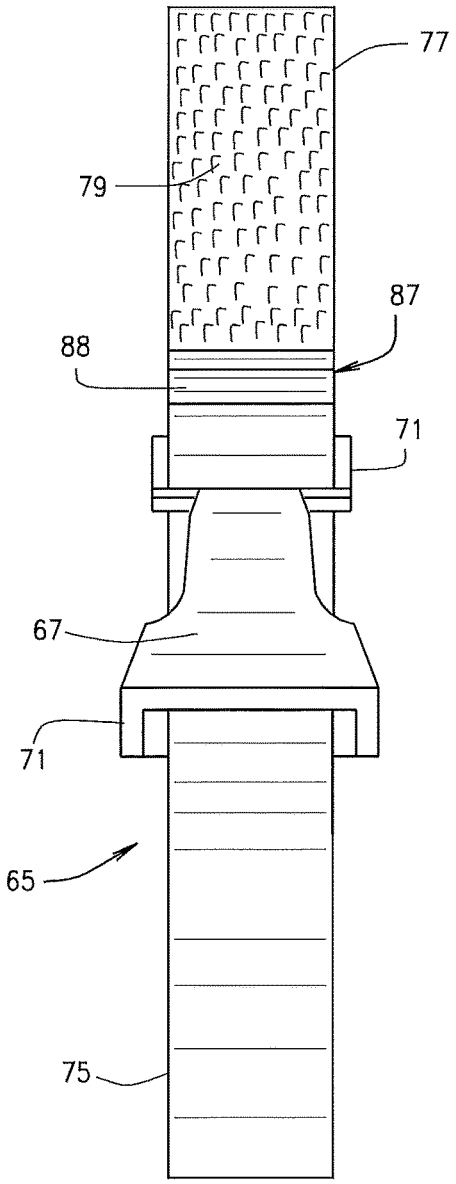
FIG. 18 is a front elevational view of the attachment member shown in FIG. 16 when it is in its open configuration.
Figure 19:
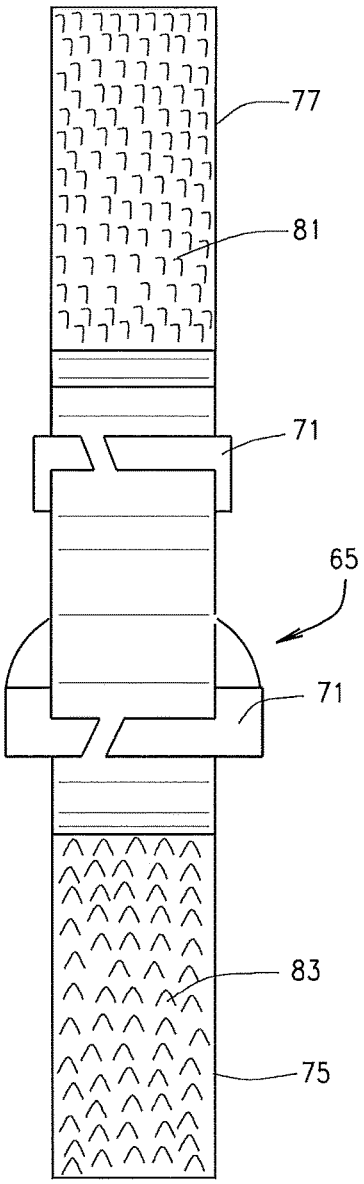
FIG. 19 is a rear elevational view of the attachment member shown in FIG. 18 when it is in its open configuration.

FIGS. 15-20 illustrate one embodiment of an attachment member 65 that can be releasably engaged with any one of the plurality of loop members 33 associated with utility belt 1 for attaching various pouches, pockets and other similar devices to the present belt. As best illustrated in FIGS. 15-17, attachment member 65 includes a female buckle/clip type connector member 67 attached to a strap member 69 which is fed through a pair of strap retainer tabs 71 associated with the female connector member 67 as best illustrated in FIGS. 17 and 19. The strap member 69 includes a folded over upper strap portion 73, a lower strap portion 75 and a strap portion 77 for feeding through a respective loop member 33. Strap portion 77 includes attachment mechanisms 79 and 81 on each opposite side thereof as best illustrated in FIG. 17, such attachment mechanisms, in one embodiment, being a mating surface of a Velcro® hook and loop fastener. In similar fashion, the lower strap portion 75 likewise includes attachment member 83 for overlapping and engaging attachment member 79 associated with strap portion 77, attachment member 83, in one embodiment, likewise being a corresponding mating Velcro® hook and loop fastener.

The attachment member 65 is selectively releasably attached to any one of loop members 33 by first positioning and sliding strap portion 77 downwardly through a particular loop member 33 such that fastening mating surface 81 lies adjacent to and abuts the back side of the respective loop member 33 as best illustrated in FIG. 15. In one embodiment, the back side of any one or more of loop members 33 may likewise include a corresponding attachment member 85 (FIG. 15) compatible with attachment member 81 such that mating surfaces 81 and 85 will engage each other when positioned in abutting relationship thereto as again illustrated in FIG. 15. Use of attachment member 85 on the back side of any one or more of loop members 33 is optional but such an arrangement provides for additional support and security to the attachment member 65 when strap portion 77 is positioned within loop member 33 as described above. Use of optional attachment member 85 further strengthens the adherence of attachment member 65 within a given loop member 33. Such increased adherence further helps to support any attachments to attachment member 65, for example, attaching various pouches or pockets such as pouch 89 illustrated in FIG. 20 as will be further discussed.

Once strap portion 77 is positioned within loop member 33, lower strap portion 75 of strap member 69 is then likewise subsequently inserted upwardly through the same loop member 33 such that its mating attachment surface 83 will engage the corresponding mating attachment surface 79 associated with strap portion 77. This arrangement and engagement is shown in FIG. 15. Overlapping strap portion 75 with strap portion 77 as illustrated in FIG. 15 provides a tight secure attachment of attachment member 65 to any one of loop members 33. Also, attachment of attachment member 65 to loop member 33 in accordance with the method disclosed above likewise positions the female buckle/clip type connector member 67 in a downward position ready to receive a corresponding male connector member as will be hereinafter further explained.

As best illustrated in FIGS. 15-17, attachment member 65 may further include a reinforcement mechanism 87 for further providing support and strength to the overall attachment member 65. In the particular embodiment illustrated in FIGS. 15-17, reinforcement mechanism 87 is simply strap member 69 doubled back onto itself (strap portion 73) so as to reinforce itself at that particular location. An additional piece of strap material 88 may be additionally attached to the doubled over strap portion 73 as best illustrated in FIG. 15. Strap member 88 can be attached to the doubled over strap portion 73 by simply stitching the same thereto. Other means for attachment are likewise envisioned and anticipated. Reinforcement mechanism 87 provides additional strength and support for any additional weight associated with an attachment such as pouch member 89 illustrated in FIG. 20 so that any such additional weight will not damage that portion of strap member 69 bearing the majority of such weight.

Figure 20:
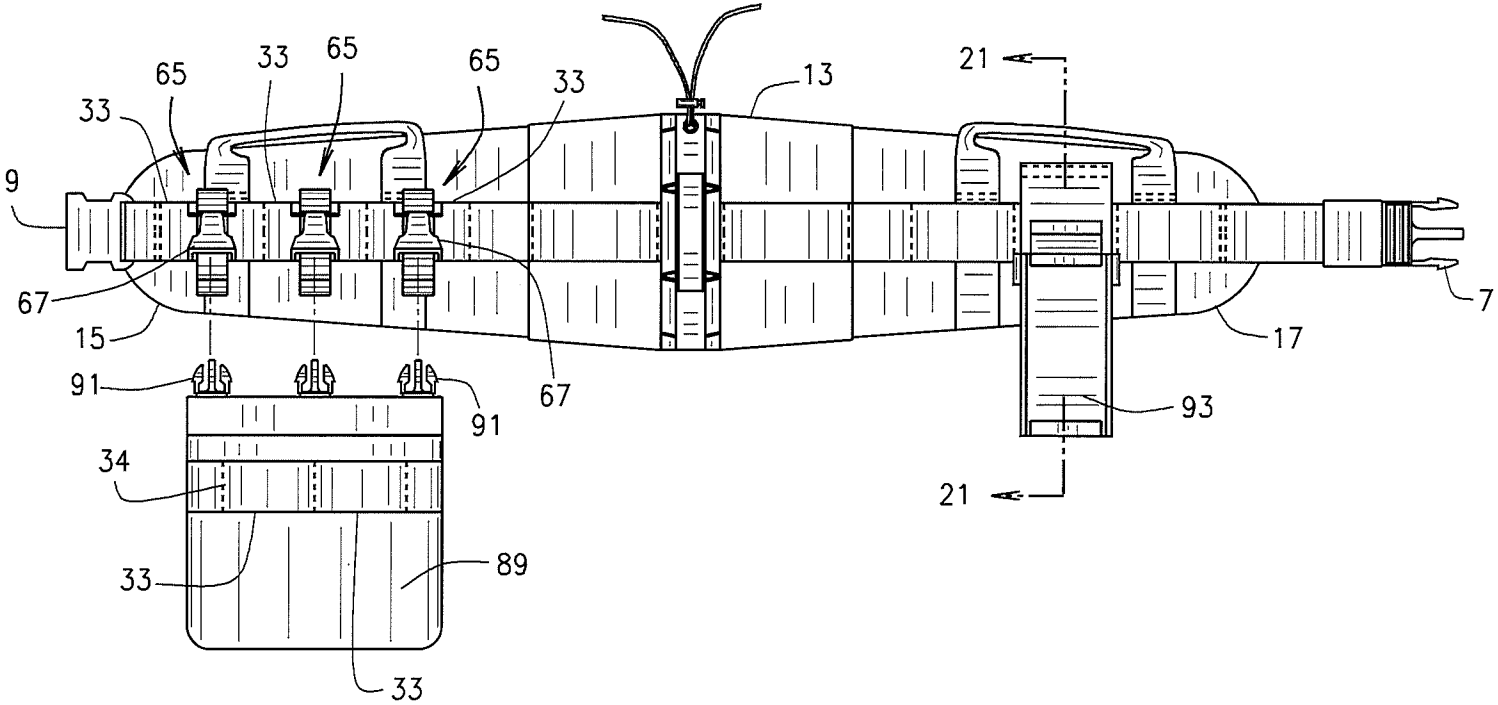
FIG. 20 is an exploded front elevational view of the utility belt shown in FIG. 1 with various pouches illustrated for attachment thereto.

FIG. 20 illustrates the attachment of a pouch 89 to a plurality of attachment members 65 as just described. In this particular embodiment, a plurality of adjustment members 65 are positioned and located for attachment to a plurality of loop members 33 such that the female connector member 67 is positioned and located in substantial alignment with a plurality of male buckle/clip type connector members 91 associated with pouch 89. In similar fashion, any number of accessory pouches and/or pockets can be fitted and designed with a plurality of male connector type members 91 for engagement with the female connector member 67 associated with attachment members 65. This allows a user to selectively releasably position the attachment members 65 at preferred locations on utility belt 1 for attaching a corresponding pouch or pocket thereto for holding a wide variety of tools, implements, nails, screws, other fasteners, and other devices necessary for accomplishing a particular task. Attachment members 65 therefore further provide the user with more flexibility in attaching various devices to utility belt 1 at preferred locations.

Figure 21:
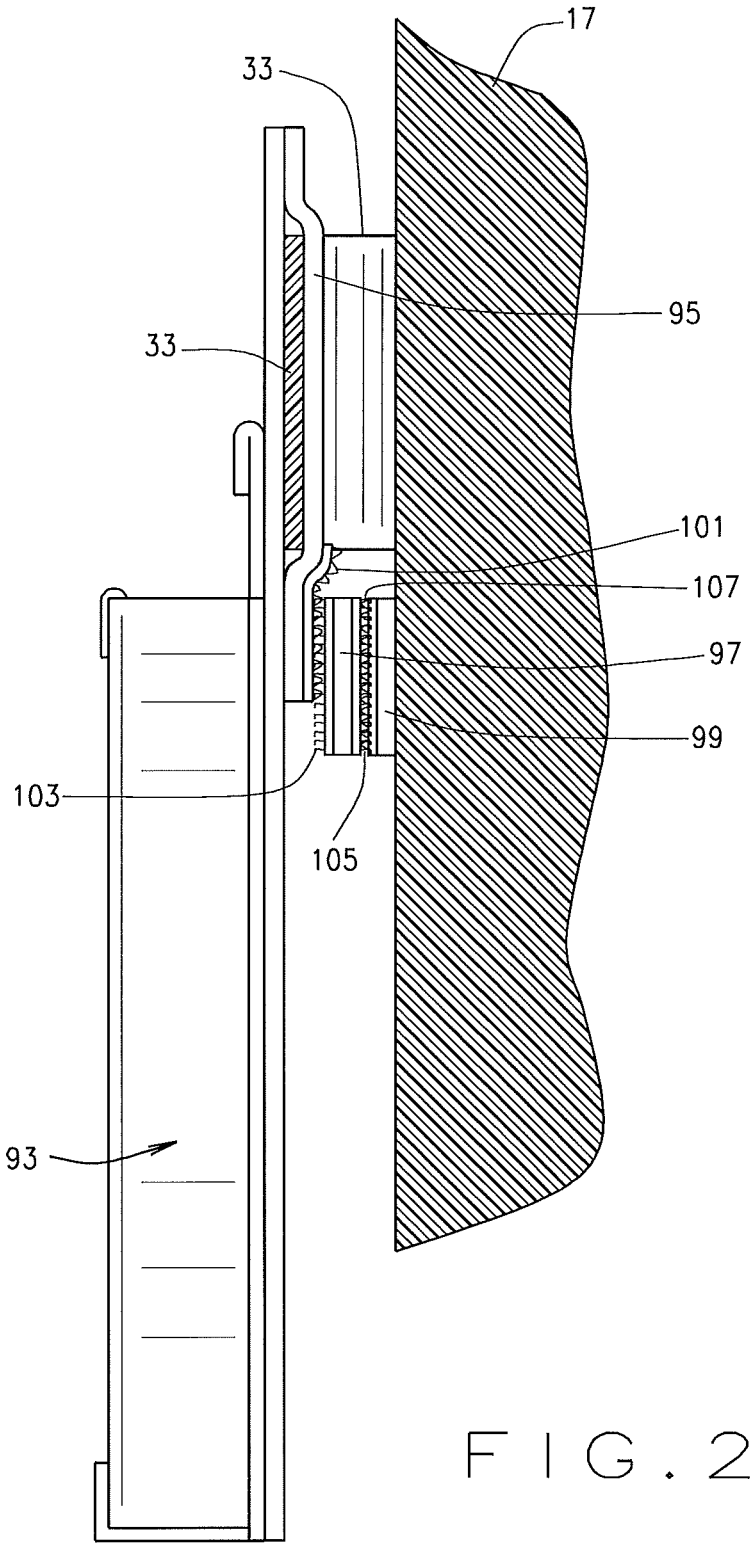
FIG. 21 is a cross-sectional view of a sheath/pouch engaged with a loop member of the present utility belt taken along the line 21-21 of FIG. 20.

In still another embodiment associated with the present utility belt 1, a sheath/pouch 93 illustrated in FIG. 20 can likewise be attached to any one of the plurality of loop members 33 using the integrated modular attachment system disclosed in co-pending U.S. patent application Ser. No. 14/745,719, the disclosure of which is incorporated herein by reference in its entirety. As best illustrated in FIG. 21, the integrated modular attachment system associated with pouch 93 includes a foldable flap 95, a first wing member 97 extending from one side of pouch 93, and a second wing member 99 extending from its opposite side. To secure the pouch 93 to any one of the loop members 33 associated with utility belt 1, the foldable flap 95 is positioned in a downward position and inserted through at least one of the loop members 33 as illustrated in FIG. 21. The first wing member 97 is then folded into a position which overlaps a portion of the foldable flap 95 and is removably secured thereto through the use of mating fastening surfaces 101 and 103 as best illustrated in FIG. 21. These mating surfaces can be Velcro® mating surfaces such as Velcro® hook and loop fasteners. The second wing member 99 is then folded over to overlap the first wing member 97 and is removably secured to at least the first wing member 97 through the engagement of mating surfaces 105 and 107. Mating surface 105 is located on the second wing member 99 and mating surface 107 is located on the first wing member 97, or vice versa. Here again, mating surfaces 105 and 107 can be Velcro® mating surfaces such as Velcro® hook and loop fasteners. A full and complete disclosure of the integrated modular attachment system associated with pouch 93 and its attachment to any one of loop members 33 is clearly disclosed in co-pending U.S. patent application Ser. No. 14/745,719. This arrangement securely attaches pouch 93 to the present utility belt in a secured manner and allows a user to easily remove pouch 93 from the belt 1 by simply reversing the above steps. Since a plurality of loop members 33 are associated with the exterior of the present utility belt 1, any particular pouch, pocket, holster or other device incorporating the integrated modular attachment system disclosed in co-pending U.S. patent application Ser. No. 14/745,719 can be easily and securely attached to the present utility belt 1 at any loop member location and the same item or object can be disengaged and selectively repositioned to any other loop member 33 associated with the present utility belt 1 as needed by a particular user.

The present utility belt 1 may be further stiffened or strengthened with rigid plastic and/or foam material to help support the weight of any accessories attached thereto. This plastic or additional foam material can be associated with the respective wing members 15 and 17 as well as with center belt member 13. In another embodiment, utility belt 1 can be covered with nylon fabric because of its lightweight and quick drying properties. In alternative embodiments, the present utility belt can be made of any alternative material and may be reinforced with any suitable material.

The various constructions described above and illustrated in the drawings are presented by way of example only and are not intended to limit the concepts and principles of the present invention. Thus, there has been shown and described several embodiments of a novel utility belt. As is evident from the foregoing description, certain aspects of the present invention are not limited by the particular details of the examples illustrated herein, and it is therefore contemplated that other modifications and applications, or equivalents thereof, will occur to those skilled in the art. The terms "having" and "including" and similar terms as used in the foregoing specification are used in the sense of "optional" or "may include" and not as "required". Many changes, modifications, variations and other uses and applications of the present constructions will, however, become apparent to those skilled in the art after considering the specification and the accompanying drawings. All such changes, modifications, variations and other uses and applications which do not depart from the spirit and scope of the invention are deemed to be covered by the invention which is limited only by the claims which follow.

What is claimed is:

1. A utility belt having a length comprising:

a center member;

a first wing member separate from said center member and movable relative to said center member;

a second wing member separate from said first wing member and from said center member, said second wing member movable relative to said center member and relative to said first wing member, said first and second wing members each having opposite end portions, one end portion of said first wing member being cooperatively engageable with one end portion of said second wing member and the other end portion of said first wing member being adjustable relative to the other end portion of said second member and relative to said center member;

an adjustment member engageable with the other end portions of said first and second wing members for adjusting said first and second wing members relative to each other, said adjustment member enabling at least one of said first and second wing members to move relative to the other wing member to extend or contract the overall length of the utility belt; and a first cummerbund member and a second cummerbund member separate from said first cummerbund member, said first and second cummerbund members each including opposite end portions, one end portion of each of said first and second cummerbund members being releasably engageable with each other and the opposite end portion of each of said first and second cummerbund members being releasably engageable with the center member.

2. The utility belt of claim 1 wherein said center member includes at least one flap member positioned and located for overlapping at least a portion of said first and second cummerbund members when said first and second cummerbund members are engaged with said center member.

3. The utility belt of claim 1 including one or more loop members associated with said first and second wing members and said center member for receiving and engaging various tools and other attachments thereto.

4. The utility belt of claim 3 including at least one attachment member releasably engageable with one of said loop members, said at least one attachment member including a first strap portion, a second strap portion and a connector member attached thereto, said first and second strap portions being inserted respectively into one of said loop members such that said second strap portion overlaps said first strap portion.

5. The utility belt of claim 1 wherein said center member includes a first sleeve member and a second sleeve member, said first sleeve member receiving one of said first and second wing members and said second sleeve member receiving the other of said first and second wing members.

6. The utility belt of claim 1 wherein said adjustment member includes a cord member interlaced with each of the other end portions of said first and second wing members such that when the cord member is pulled, said cord member engages the first and second wing members and pulls said wing members toward each other.

7. The utility belt of claim 1 wherein said adjustment member extends through an aperture associated with said center member.

8. The utility belt of claim 1 including at least one handle member associated with one of said first and second wing members.

9. The utility belt of claim 1 including a pouch positioned and located on said center member for holding a pencil and other devices.

10. The utility belt of claim 1 wherein each of said first and second wing members includes at least one strap member for receiving said first and second cummerbund members.

11. The utility belt of claim 1 wherein said first and second cummerbund members are adjustable relative to each other.

12. The utility belt of claim 1 wherein the respective opposite end portions of said first and second cummerbund members releasably engageable with said center member are likewise releasably engageable with each other.

13. The utility belt of claim 1 wherein said center member includes an attachment member, and wherein the opposite end portion of each of said first and second cummerbund members are releasably engageable with said attachment member.

14. The utility belt of claim 1 wherein each of said first and second wing members includes at least one sleeve member, the at least one sleeve member associated with said first wing member being positioned and located for receiving one of said first and second cummerbund members, and the at least one sleeve member associated with said second wing member being positioned and located for receiving the other of said first and second cummerbund members.

15. The utility belt of claim 13 wherein said center member includes first and second flap members, said first and second flap members being cooperatively engageable with each other, said first flap member being movable to overlap the engagement of the opposite end portion of each of said first and second cummerbund members with said center member, and said second flap member being movable to overlap said first flap member and being selectively engageable therewith.

16. The utility belt of claim 6 including a stop member engageable with said cord member for holding said cord member at a desired position.

17. The utility belt of claim 1 including a pair of handle members, one of said handle members being associated with said first wing member and the other of said handle members being associated with said second wing member.

18. The utility belt of claim 3 including at least one attachment member releasably engageable with any one of said loop members.

* * * * *